US006305355B1

(12) United States Patent
Hoffmann et al.

(10) Patent No.: US 6,305,355 B1
(45) Date of Patent: Oct. 23, 2001

(54) CONTROL DEVICE FOR A HIGH-PRESSURE INJECTION NOZZLE FOR LIQUID INJECTION MEDIA

(75) Inventors: Kal-Heinz Hoffmann, Stuttgart; Olav Krenz, Leonberg; Manfred Müller; Claus Stenger, both of Stuttgart, all of (DE)

(73) Assignee: DaimlerChrysler AG, Stuttgart (DE)

( * ) Notice: Subject to any disclaimer, the term of this patent is extended or adjusted under 35 U.S.C. 154(b) by 0 days.

(21) Appl. No.: 09/707,177

(22) Filed: Nov. 6, 2000

Related U.S. Application Data

(63) Continuation-in-part of application No. PCT/EP99/02908, filed on Apr. 29, 1999.

(30) Foreign Application Priority Data

May 7, 1998 (DE) ..... 198 20 341

(51) Int. Cl.[7] ..... F02M 41/00
(52) U.S. Cl. ..... 123/467; 123/458; 251/129.16
(58) Field of Search ..... 123/467, 500, 123/501, 458; 251/129.16, 129.13, 129.07

(56) References Cited

U.S. PATENT DOCUMENTS 5,288,025 * 2/1994 Cerny ..... 239/533.8
5,370,355 12/1994 Rembold et al. .
5,381,999 * 1/1995 Ricco ..... 251/129.16
5,752,489 * 5/1998 Henderson et al. ..... 123/494
5,820,101 * 10/1998 Ricco ..... 251/129.16
5,984,259 * 11/1999 Najmolhoda et al. ..... 251/50
6,059,545 * 5/2000 Straub et al. ..... 417/505
6,199,774 * 3/2001 Ricco ..... 239/533.8

FOREIGN PATENT DOCUMENTS 195 42 642 A1 5/1997 (DE) .
0 753 658 A1 1/1997 (EP) .

* cited by examiner

*Primary Examiner*—Carl S. Miller
(74) *Attorney, Agent, or Firm*—Klaus J. Bach

(57) ABSTRACT

In a control device for a high pressure injection nozzle including a housing, an actuating magnet structure disposed in the housing and including a magnetic coil, an armature movable relative to the coil, and a valve actuating bolt engaged by the armature and being spring-biased to a seated position in which the injection nozzle is closed, the armature is movably mounted on the armature bolt and a mass body is resiliently supported adjacent the armature so that, upon de-energization of the magnet coil when the armature and the spring biased bolt are released and the bolt reaches the seated position, the armature is free to continue to move for engagement with the mass body to which the mass impulse forces of the armature are transferred, whereby the mass forces generated by the bolt when being seated are reduced and the movement of the armature is damped.

24 Claims, 9 Drawing Sheets

CONTROL DEVICE FOR A HIGH-PRESSURE INJECTION NOZZLE FOR LIQUID INJECTION MEDIA

This is a cip application of international application PCT/EP99/02908 filed Apr. 29, 1999 and claiming the priority of German application 198 20 341.1 filed May. 7 1998.

BACKGROUND OF THE INVENTION

The invention relates to a control device for a high-pressure injection nozzle for liquid injection media, in which the injection medium is under high pressure at the nozzle and is metered via based on injection time, injection duration and/or injection quantity, in particular, to a control device for a high-pressure fuel injection nozzle for internal combustion engines with self-ignition and a common rail fuel supply.

Injection nozzles of the above-mentioned type are known from EP 0 753 658 A and consist of the nozzle part with the nozzle needle, which is spring-loaded in the closing direction, and a valve piston which is arranged in the axial extension of the nozzle needle. The valve piston is disposed in alignment with the nozzle needle and forms the connection to the actuating device. The nozzle needle is biased toward its closing direction by the high-pressure injection medium so that the nozzle needle is closed between the injections. The pressure space, on the one hand, is delimited by the valve piston, and is connected via a throttle to the high-pressure supply, that is, in common rail injection systems, the common pressurized fuel distribution line. On the other hand, the pressure space is in communication, via a further throttle, to the return of the fuel supply system to a tank. A throttle located in the connection to the return is capable of being shut off via a shut-off member of the actuating device, the shut-off member being formed by a valve ball. The valve ball acting as a shut-off member is operable by a magnet armature, which comprises an armature bolt and an armature plate. The armature plate is longitudinally displaceably on the latter and interacts with the magnet coil of the solenoid valve of the actuating device. The longitudinal displaceability of the armature plate relative to the armature bolt in the opening direction of the shut-off member is limited by a stop for the armature bolt. The armature plate is biased in the direction of this stop by a relatively weak armature spring. In the opposite direction, that is, toward the closing position of the shut-off member, the armature bolt is engaged by a valve spring which, on the one hand, maintains the closing position, but, on the other hand, can be overcome when current is applied to the magnet coil. Then the shut-off member opens and the pressure space is placed in communication with the return by the valve piston by way of the throttle. As a result, the force exerted on the nozzle needle in the closing direction by the valve piston is reduced so that the nozzle needle can be lifted by the high-pressure medium present at the nozzle needle to open the injection orifice.

The magnet armature, consisting of the valve ball forming the shut-off member, the armature bolt and the armature plate, moves back and forth very quickly between the stops in order to carry out the injection operations. The stops are formed on the one hand by the seat surface of the valve ball and, on the other hand, by a housing-side stop for the armature bolt. The corresponding valve opening periods are between 0.2 and 2 ms. The stroke length is approximately 50 $\mu$m.

In conjunction with the high pressures to be controlled, the high switching speeds and also the high positive and negative accelerations during impingement on the stops, pronounced elastic oscillations occur. As a result, the valve ball when hitting the stop formed by the sealing seat opens again briefly in spite of the forces acting in the closing direction. In order to prevent such re-opening, the armature plate is mounted movably on the armature bolt, so that the armature plate is pressed by the armature spring against the associated stop on the armature bolt in the opening direction of the valve. When the armature bolt or the valve ball engages the valve seat, the armature plate, as a result of its mass inertia, can move off the stop by overcoming the engagement force exerted thereon by the armature spring. In this way the magnet armature mass forces effective upon engagement are reduced to such an extent that the mass forces of the magnet armature can remain below the pre-stressing force of the valve spring.

In order to accommodate oscillatory effects which occur despite these measures and which influence the injection operations in an uncontrolled way, in particular the respective injection times and injection quantities, the armature includes a region which is filled with the injection medium. In this area, the armature also includes a radial flange which cooperates with a housing-side abutment surface in the opening direction of the shut-off member (valve ball) of the actuating device, so that the opening movement of the armature bolt is damped upon displacement of injection medium located in the gap between the radial flange and abutment surface. This damping however does not eliminate oscillatory effects which emanate from the axially movable armature plate when the shut-off member formed by the valve ball is seated that is to say during the closing of the shut-off member.

When the valve ball impinges onto its seat, the armature plate continues to move in the closing direction of the armature bolt against the force of the armature spring. As a result, the mass forces associated with the deceleration of the armature bolt are reduced in a desirable way. The armature plate moves as far as a respective reversal point against the force of the armature spring and is then forced back by the armature spring into engagement with the stop of the armature bolt. Although the spring force is relatively weak, during impingement onto the stop, mass forces are again generated which, although being much lower, nevertheless can entail a slight movement of the armature bolt in the opening direction of the shut-off member. Even if this does not ultimately lead to an opening but only to a relief of the engagement force with the seat surface, oscillations generated thereby may behave an adverse effect when there is some time overlap in the activation of the solenoid valve, for example, when the main injection follows a pre-injection with a short time delay.

What may be decisive for this is, inter alia, that the mass force occurring during the deceleration of the armature plate is directed counter to the pre-stressing force of the valve spring and thereby reduces the effective pre-stressing force. If the abutment of the armature plate coincides in time with the energization of the magnet, the reduced effective pre-stressing force results in a reduced response time of the solenoid valve. The opposite effect occurs when the magnet is energized prior to abutment.

Further influences may result from the fact that the speed of the magnet armature changes as a whole, specifically from a positive to a negative maximum value when the armature plate engages its stop at the armature bolt. If the magnet is energized during this time, the momentary speed of the magnet armature is effectively the initial speed for the subsequent armature stroke movement. This results in corresponding downward or upward deviations from the opening speed as established from a state of rest. Corresponding influences are also exerted when the magnet is energized during the movement phase of the armature plate that is in intermediate positions of the armature plate.

Since oscillatory actions as they occur, for example, when the armature plate impinges onto the stop, do not suddenly fade away, there may be a so-called armature rebound, a repeated engagement of the armature plate with the stop at decreasing intensity. This results in additional effects which, overall, are detrimental to maintaining the predetermined desired injection values. It is therefore very difficult to meter the injection quantity correctly. In internal combustion engines of vehicles, there maybe an adverse influence both on the deployment of power and on the driving behavior of the vehicle.

Furthermore, U.S. Pat. No. 5,370,355 discloses a quick-switching solenoid valve which is to be used, in particular, in conjunction with fuel injection pumps, for controlling fuel injection. Here, the armature plate and armature bolt form a rigid unit, which is acted upon by a disc spring, which engages on the armature bolt. The bolt is loaded by the spring counter to the lifting direction of the magnet and is supported on the housing side. The disc spring forms a diaphragm, which, at the same time, delimits the magnet space toward the side, which is acted upon by the injection medium. In this region, the armature bolt has a radial flange for engagement with a housing-side abutment surface. When the magnet is de-energized and a corresponding force is generated by the disc spring, the unit formed by the armature plate and armature bolt is damped as a result of the displacement of the injection medium located between the radial flange and abutment surface.

A piston-like slide member forming a 2/2-way valve is provided coaxially to the armature bolt and guided in the housing by which slide member the flow of fuel through the valve is controlled. In its shut-off position, in which fuel flow passage is blocked, the piston-like slide member is in an abutment position relative to the housing under the force of a spring supported on the armature bolt.

The maximum extension and therefore the pre-stress of the spring acting upon the piston-like slide member when current is applied to the magnet and the piston-like slide member is in the opening position is determined by a stop bolt which is co-axial to the armature bolt and is screwed into the latter. It is provided with a stop head, which is engaged by the end face of the piston-like slide member under the force of the spring. When the piston-like slide member is in its closing position corresponding to the position of the armature when the magnet is de-energized, the stop bolt entering the piston-like slide member is lifted off the piston-slide abutment surface formed by the end face and the piston-like slide member is subjected to the load by the spring force, which depends on the lifting clearance. In this arrangement, the piston-like slide member is not damped although the armature, together with the armature bolt, is damped when it drops after the magnet has been de-energized. There is also some uncoupling between the piston-like slide member on the one hand and the armature and armature bolt on the other hand due to the resilient support, but oscillations of the piston-like slide member are not damped when the piston-like slide member engages its seat surface. In any case, this does not address the relevant problems arising from the design of the shut-off member as a piston-like slide member with oscillation-damping slide guides.

It is the object of the present invention to improve the oscillatory behavior of an actuating device of the type mentioned in the introduction thereby to achieve a stabilization of the fuel injection operations.

SUMMARY OF THE INVENTION

In a control device for a high pressure injection nozzle including a housing, an actuating magnet structure disposed in the housing and including a magnetic coil, an armature movable relative to the coil, and a valve actuating bolt engaged by the armature and being spring-biased to a seated position, in which the injection nozzle is closed, the armature is movably mounted on the armature bolt and a mass body is resiliently supported adjacent the armature so that, upon de-energization of the magnet coil, when the armature and the spring-biased bolt are released and the bolt reaches the seated position, the armature is free to continue to move for engagement with the mass body to which the mass impulse forces of the armature are transferred whereby the mass forces generated by the bolt when being seated are reduced and the movement of the armature is damped.

With this solution, which leads to a particularly simple design and is also particularly advantageous with regard to utilizing the spatial conditions in the space receiving the armature, the mass body is pressed with relatively low pre-stressing force against the armature plate. At the same time, the pre-stressing force is so selected that the mass body remains virtually stationary during the time when the armature plate, attracted by the magnet, moves towards the latter. The mass body therefore remains at rest during the valve opening time and, because of its mass inertia, initially will not follow the armature plate. When the armature plate abuts its stop on the armature bolt at the maximum opening stroke, it impinges onto the mass body with a time delay during spring-back. The spring-back energy of the armature plate is virtually compensated by the impinging mass body and a corresponding kinetic energy is transmitted to the mass body. After this impulse, the armature plate executes only a very slight movement, particularly when the ratio of the masses of the armature plate and the mass body is about 1 to 1 and the number of impulses is not much lower than 1. As a result, the armature plate remains virtually in the abutting position rested against its stop even if, as in an internal combustion engine where pre-injection may be followed by a further pre-injection or by the main fuel injection, the time interval in relation to first injection is at most about 2 ms.

Although the mass body itself is then not yet at rest, its oscillations fade during the closing time of the solenoid valve. The mass body then reaches again its rest position opposite the armature plate into which it is biased by the weak support spring, thereby assuming its original position for subsequent injection operations.

Particularly in conjunction with an embodiment in which the armature bolt is disposed, together with the armature plate, in the flow path to the return which is controlled by the shut-off valve, or is in communication with the latter so that the armature space is filled with liquid, additional hydraulic damping is obtained. This provides for damping of the movements of the mass body. The damping may be achieved by narrow guide structures for the mass body in the armature space and also by appropriate configurations of the armature plate and/or of the mass body. In conjunction with the axial movement of the mass body, they lead to a corresponding displacement of liquid and consequently to a certain amount of damping.

It is particularly advantageous, in this respect, if the mass body and/or the armature plate have axially extending projections defining therebetween radial passages, so that a radial through-flow is possible despite the fact that the mass body rests against the armature plate.

In order to permit the arrangement of the preferably annular mass body in the armature space, the mass-body spring acting on the mass body is a spirally coiled helical spring. Preferably, the turns of the spring do not overlap radially, so that, when the spring is fully compressed, the turns lie one in the other and all in one plane.

The mass-body spring may also be in the form of a Belleville spring, which may further be radially slotted so as to have elastic radial fingers. A small volume can be achieved thereby along with a good hydraulic through-flow capacity and a soft spring characteristic.

In a further embodiment of the invention, the mass body may be a two-part member located one adjacent the other. Whereas, in the case of a one-part mass body, it is advantageous to select the mass of the mass body so as to correspond approximately to the mass of the armature plate, this is not possible in the case of a mass body divided into a plurality of part-bodies. If there are smaller partial masses, these part-masses should be supported elastically relative to one another, in order to provide for an elastic impulse. This provides for the cycle of movement described, that is, for the armature plate to remain as much as possible in its initial position at the stop after the transmission of the abutment energy to the part-bodies. With this solution, it is further advantageous to leave a sufficient clearance between the part-bodies arranged adjacent one another so that fluid is displaced or replaced when the part-bodies move relative to one another. In that case, the part bodies act virtually as a single body.

In a further embodiment of the invention, the mass body may also be designed as a layered body. The appropriate layered body members used may be built up like a leaf spring in which additional damping is achieved by the friction between the individual layer elements. Mass bodies in which, by appropriate shaping of the elements forming the respective layers, for example annular discs, liquid cushions form between the individual discs, provide for damping effects during relative movement between the discs. Such a solution can be implemented in a particularly simple way if the mass body consist of layered, curved spring-steel discs. Discs of varying degree of curvature may be disposed one above the other, in such a way that support is obtained alternately at the radially inner and the radially outer ends of the discs thus providing for corresponding liquid gaps.

Additional hydraulic damping can also be provided in that the layered bodies forming the mass body are coordinated with one another and/or arranged within the armature space in such a way that narrow squeezing gaps are formed for the liquid flowing through the structure thus resulting in hydraulic damping. In a particularly simple configuration, the mass body is provided at its radially inner circumference with a cylindrical guide member by, which correspondingly narrow annular gaps are formed. This can be achieved by a guide tube, which has an outside diameter only slightly smaller than the inside diameter of the annular mass body and delimits a gap relative to the mass body. Preferably, the guide tube is fixed axially via a radial collar, which is arranged below the support spring of the mass body so as to be held thereby fixed to the housing.

Further features and embodiments of the invention will become apparent from the following description of exemplary embodiments of the invention on the basis of the accompanying drawings.

DESCRIPTION OF PREFERRED EMBODIMENTS

Figure 1:
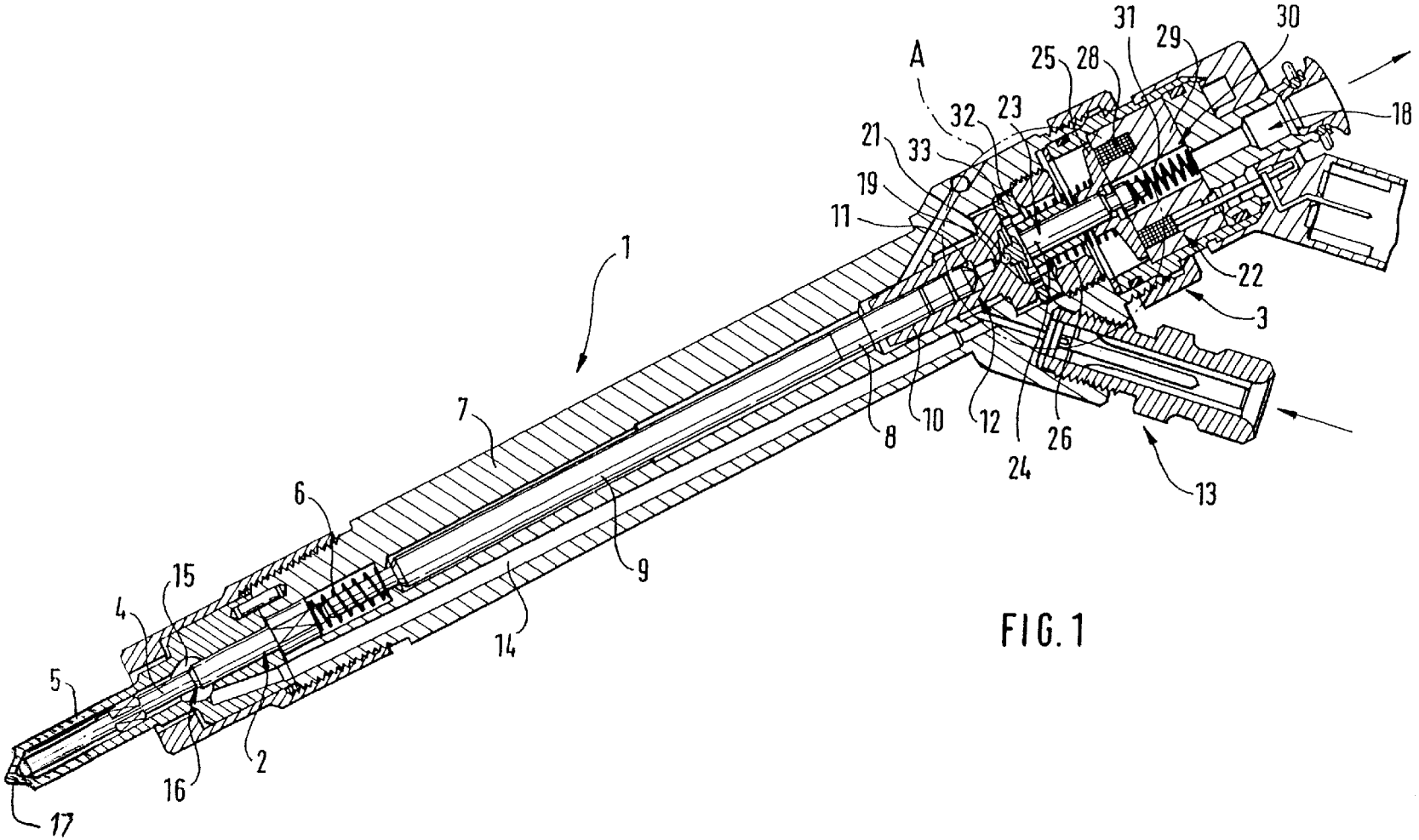
FIG. 1 is a diagrammatic illustration of a high-pressure injection nozzle, in which the injection medium, in particular fuel, is under high pressure at the nozzle and is metered by the nozzle as to injection timing, injection duration and/or injection quantity, and which includes an actuating device controlling the operation of the nozzle.

FIG. 1 shows the overall design of a high-pressure injection nozzle 1 as known in the art for internal combustion engines operating by self-ignition, in which the fuel, as injection medium, is under high pressure at the nozzle. The fuel flow is controlled by the nozzle with respect to injection timing, injection duration and injection quantity. The corresponding control is performed by an actuating device 3, which is included in the nozzle and which is addressed by a control device not illustrated here, for example, an engine control unit. Such injection nozzles 1 are used in common-rail fuel injection systems, in which the feed fuel, which is under high pressure, (up to approximately 1700 bar) is supplied to the respective fuel nozzle from a distribution line (common rail). Pressurized fuel is supplied to the distribution line by a high-pressure pump, which is not shown here.

As shown, in FIG. 1, the injection nozzle as a whole is designated by the numeral 1. It comprises a nozzle part 2 and an actuating device 3. Located in the nozzle part 2 is the nozzle needle 4, which is guided in the nozzle body 5 and is acted upon axially by a nozzle spring 6. A nozzle holder 7 recieving the nozzle needle 4 extends axially toward the actuating device 3 and includes a valve piston 8 which is supported on the nozzle needle 4 by a thrust rod 9. The thrust rod 9 extends through the nozzle holder 7 and, in a valve piece 10, forms a wall of a variable-volume pressure space 11. The pressure space 11 is in communication, via a throttle 12, with the inflow 13, that is the high-pressure fuel supply, from which a passage 14 extends through the nozzle holder 7 and the nozzle body 5 leading to the nozzle needle 4. The nozzle needle 4 is biased in the closing direction by the pressure prevailing in the pressure space 11 and also by the nozzle spring 6, via the valve piston 8 and the thrust rod 9. Loading in the opposite direction is obtained via the connection of the pressure chamber 15 to the high-pressure side by means of the passage 14, the nozzle needle 4 having a thrust shoulder 16 in the region of the pressure chamber 15.

When both the pressure space 11 and the pressure chamber 15 are connected to the high-pressure side (inflow 13), the nozzle needle 4 is held in its closing position and covers the injection holes 17 located at the nozzle tip. When the pressure in the pressure space 11 is reduced, but pressure is maintained in the pressure chamber 15, the nozzle needle 4 is lifted against the force of the nozzle spring 6 and opens the injection holes 17, so that fuel is injected.

In the region of the actuating device 3 the injection nozzle 1 has a fuel return passage 18 which receives any leakage fuel quantities occurring within the nozzle 1 and to which, moreover, the pressure space 11 is connected via a throttle 19. The throttle opening 19 extends through the valve piece 10 at the transition from the pressure space 11 to the armature space 20 of the actuating device 3. It can be closed by the shut-off member 21 of the actuating device 3 (valve ball 21).

Figure 2:
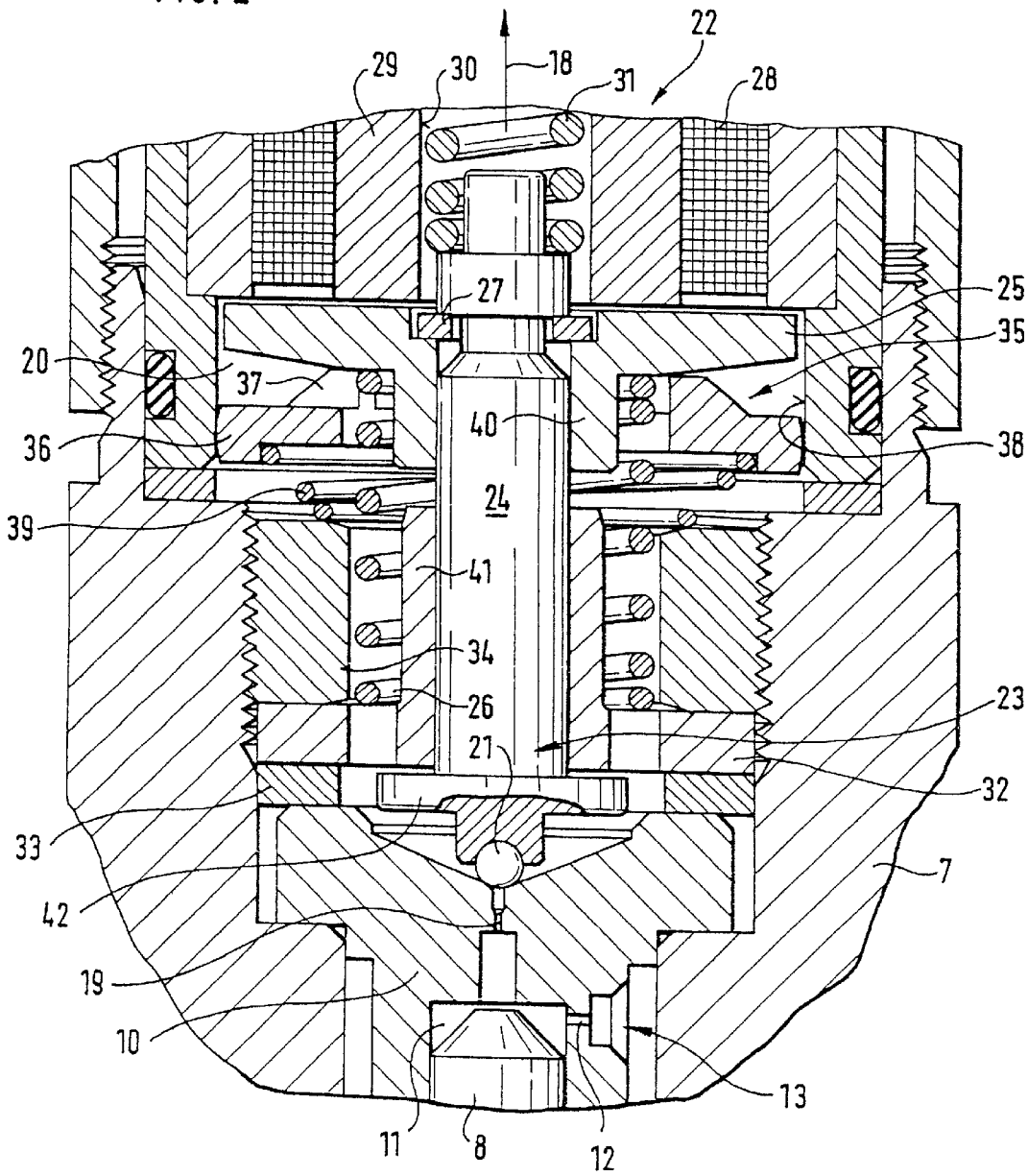
FIG. 2 is an enlarged sectional detail view of the actuating device roughly corresponding to the marked portion A of FIG. 1.

The actuating device 3, the design of which is apparent in particular from FIG. 2, comprises an actuating magnet 22 with a magnet armature 23 consisting of the armature bolt 24 having the shut-off member 21 (valve ball 21) fixedly connected to one end of the bolt 24. At the opposite end, the armature bolt 24 carries an armature plate 25, which is biased by an armature spring 26 in the direction of a stop 27 fixed to the armature bolt 24. In this case, the stop 27 limits the travel distance of the armature plate 25 relative to the armature bolt 24 in the direction of the actuating magnet 22, which includes a coil 28 and a magnetic core 29. The armature bolt 24 extends with its other end beyond the armature plate 25 and into the central orifice passage 30, which is surrounded by the magnet core 29. Within the magnet core 29, a solenoid-valve spring 31 is arranged biasing the armature bolt 24 in the closing direction of the shut-off member 21.

The armature bolt 24 is itself likewise stop-limited in its axial displacement travel, specifically, at one end, upon seating on the valve ball 21 supported on the valve piece 10. In the opposite direction, a stop is provided by an armature disc 32, whose distance from the valve piece 10 is adjustable within narrow tolerances by a spacer disc 33. The spacer disc 33 is secured by a tension nut 34, which is screwed into the nozzle holder 7. When the shut-off member formed by the valve ball 21 is open, the throttle 19 in the valve piece 10 provides for communication with the armature space 20 and further with the return 18 via the orifice passage 30.

When the armature plate 25 is drawn in the direction of the actuating magnet 22 by the actuating device 3 as the coil 28 of the actuating magnet 22 is energized, the armature plate 25 lifts the armature bolt 24 via the stop 27 and thereby lifts the valve ball 21 from its seat on the valve piece 10. As a result, the throttle 19 is opened. The pressure space 11 is placed in communication with the return 18 via the throttle 19 whereby the pressure in the pressure space 11 is reduced, since pressure equalization is prevented by the throttle 12 located in the connection to the inflow 13. With the drop in pressure space 11 and with the pressure chamber 15 continuing to be in communication with the inflow 13, the nozzle needle 4 is lifted as a result of the pressure forces exerted on the thrust shoulder 16 and consequently opens the fuel injection openings 17. The injection pressures, which may reach about 1700 bar depending on the pressure prevailing in the distribution rail, can be controlled with comparatively weak springs (nozzle spring 6, valve spring 31). This is possible by the fact that the prevailing operating pressures are utilized at the same time as closing and opening pressures, and that the necessary control and holding forces are generated essentially hydraulically via the correspondingly loaded surfaces in the pressure space 11 and in the pressure chamber 15. For this reason also extremely short switching times in the order of between 0.2 and 2 ms can be implemented, this being achieved with small control movements of the actuating device 3 in the order of about 50 $\mu$m.

With the short switching times, the travel limits provided by the stops and the oscillations occurring upon engagement of the stops may strongly affect the predetermined injection control times and therefore also the injection quantities, which may lead to disturbances in engine operation. These disturbances or the oscillations causing the disturbances can be avoided by the armature plate 25 being supported movably on the armature bolt 24 and being biased in the direction of the stop 27 merely by means of a relatively weak armature spring 26. Thus, when the armature bolt 24 or the valve ball 21 reaches the associated seat on the valve piece 10, the armature plate 25 with its mass inertia can move off the stop 27. As a result, the effective total mass of the magnet armature 23 effective upon seating of the valve ball is reduced. In this way, the mass force is kept below the pre-stressing force of the valve spring 31, so that an oscillation-induced opening of the throttle 19 via the valve ball 21 is generally avoided.

When the armature plate 25 moves off the stop 27, while the valve ball 21 is in the shut-off position, the armature plate is pushed back against the stop 27 under the influence of the armature spring 26. When hitting the stop 27, a mass force is generated which is directed counter to the closing force for the valve ball 21 and acts on the armature bolt 24 in the opening direction of the valve. This causes at least a reduction in the closing pressure for the valve ball 21 in the associated valve seat. Furthermore, the relevant oscillatory effects also have an adverse effect on maintaining the predetermined injection times.

The mass force occurring during the deceleration of the armature plate 25 is directed counter to the pre-stressing force of the valve spring 31 and thereby momentarily reduces the effective pre-stressing force. If the engagement of the armature plate 25 with the stop 27 coincides with the energization of the magnet 22, the response time of the solenoid valve is shortened. The opposite effect occurs when the actuating magnet 22 is energized before the armature plate 25 reaches the stop 27.

Furthermore, when the armature plate 25 hits the stop 27 arranged on the armature bolt 24, the entire magnet armature 23 (armature plate 25, armature bolt 24 and valve ball 21) under-goes a change in speed from a positive to a negative maximum value. If this instantaneous speed change coincides with the energization of the actuating magnet 22, it becomes the initial speed for the subsequent movement of the magnet armature 23. This results in corresponding downward or upward deviations in the armature speed during the subsequent movement and therefore causes corresponding variations in the predetermined injection control values.

Figure 3:
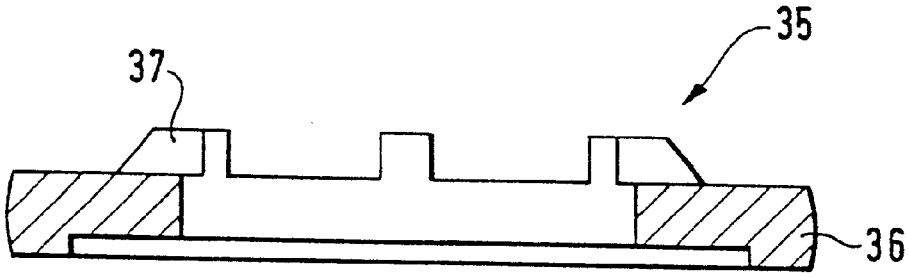
FIG. 3 is a sectional illustration of the mass body used in the illustration according to FIG. 2.
Figure 4:
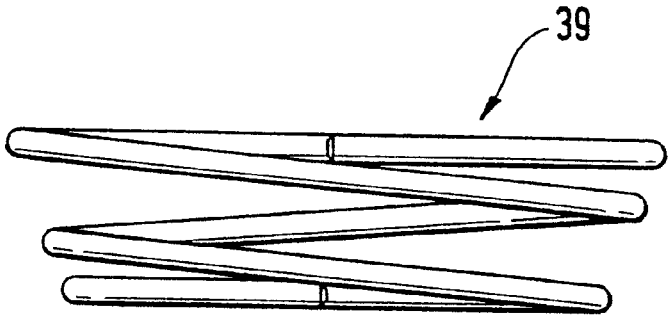
FIG. 4 is an enlarged view of the mass body support spring.

Therefore, in accordance with the invention, damping is provided for the armature plate 25. In the exemplary embodiment according to FIG. 2, which shows a preferred embodiment of the invention, such damping is accomplished by a mass body 35 which, as illustrated in FIG. 3, is an annular member 36 provided with projections 37. The projections 37 extend toward the armature plate 25 and are distributed over the radially inner circumference of the annular body 36 in circumferentially spaced relationship so that radial orifice passages remain between the projections 37. These orifices prevent the formation of hydraulic cushions during the axial relative movements of the armature plate 25 in relation to the mass body 35. Furthermore, in order to provide for appropriate hydraulic damping, it is advantageous if the outer circumference of the annular body 35 has only a slight play relative to the inner circumference of the armature space 20. In this way, axial movements of the mass body 35 are hydraulically damped since the hydraulic fluid is forced through relatively narrow gaps.

The mass body 35 is biased in the direction of the armature plate 25 by a mass-body spring 39, which is relatively soft. Moreover, the spirally coiled helical spring 39 has coils of decreasing diameter such that, in the compressed state, its turns are disposed within one another. As a result, in the fully compressed state, the spring 39 has a height which corresponds to the thickness of the spring wire. Such an embodiment is advantageous since the mass body 35 can then be mounted with the least possible overall height below the armature plate 25. Also the stop 27 can be mounted on the armature bolt 24 so as to allow the axial displacement of the armature plate 25 irrespective of the additional mass body 35 provided for the armature plate 25. FIG. 2 shows furthermore that the armature plate 25 has a neck-like extension 40, which provides for guidance on the armature bolt 24 and which, in interaction with a flange 41 of the armature disc 32, forms an axial travel limitation for the displacement of the armature plate 25 in the direction toward the valve seat of the valve piece 10. In the enlarged illustration according to FIG. 2, it can also be seen that the armature disc 32, which is fixed to the housing, forms a stop for the armature bolt 24 in the direction of movement toward the actuating magnet 22, as the armature bolt 24 is provided with a corresponding stop flange 42.

An advantageous mass ratio between the mass body 35 and the armature plate 25 has been found to be a ratio of about 1:1.

According to the invention, the mass-body spring 39 is selected in such a way that the mass body 35 movement is delayed in relation to the armature plate 25, when the armature bolt 24 is lifted via the armature plate 25 as the actuating magnet 22 is energized. The mass body 35 essentially maintains its initial position depending, inter alia, on the resistance of the liquid located in the armature space 20 to a displacement of the mass body 35. After the actuating magnet 22 is energized and the magnet armature 23 has reached its upper end position, that is the position in which the valve is open and wherein the flange 42 abuts the armature disc 32, and the magnet 22 is subsequently de-energized, the armature 23 drops and returns to the close the valve. As the valve ball 21 is seated, the armature plate 25 continuous to move and lifts off the stop 27 and impinges onto the mass body 35. As a result, assuming approximately identical masses of the armature plates 25 and of the mass body 35, the energy of the armature plate 25 is transferred to the mass body 35 and armature plate 25 maintains virtually its initial position in relation to the stop 27. The armature plate 25 is engaged by a substantially stronger spring 26 than the mass body 35 which is engaged by the mass-body spring 39. As the armature plate 25, as a result of its interaction with the mass body 35, essentially maintains its position at the stop 27 and any acceleration forces are initially taken over by the mass body 25, which is an essentially freely oscillating element, undesirable reciprocal influences are largely avoided. This is true even for very brief successive energizations of the magnet 22 as they occur for example during successive pre-injections or with a pre-injection followed by the main injection of fuel. With the arrangement according to the invention therefore, on the one hand, the mass force effective during the closing of the valve is reduced in a desirable way as a result of the axial displaceability of the armature plate 25 on the armature bolt 24. At the same time, the impuls transfer to the mass body 35 ensures that the armature plate 25 essentially maintains its position adjacent the stop 27. The mass forces which are absorbed by the mass body 35 forming a kind of "free oscillator" are transferred to the magnet armature 23 at a later time when the injection operating sequence is not affected thereby, particularly during the transitional time to the next injection cycle. The additional damping which is achieved by the arrangement of the mass body, its design and/or its hydraulic effects, and also the composition of the mass body 35 completely or partially of material with high internal material damping have further beneficial effects.

Figure 5:
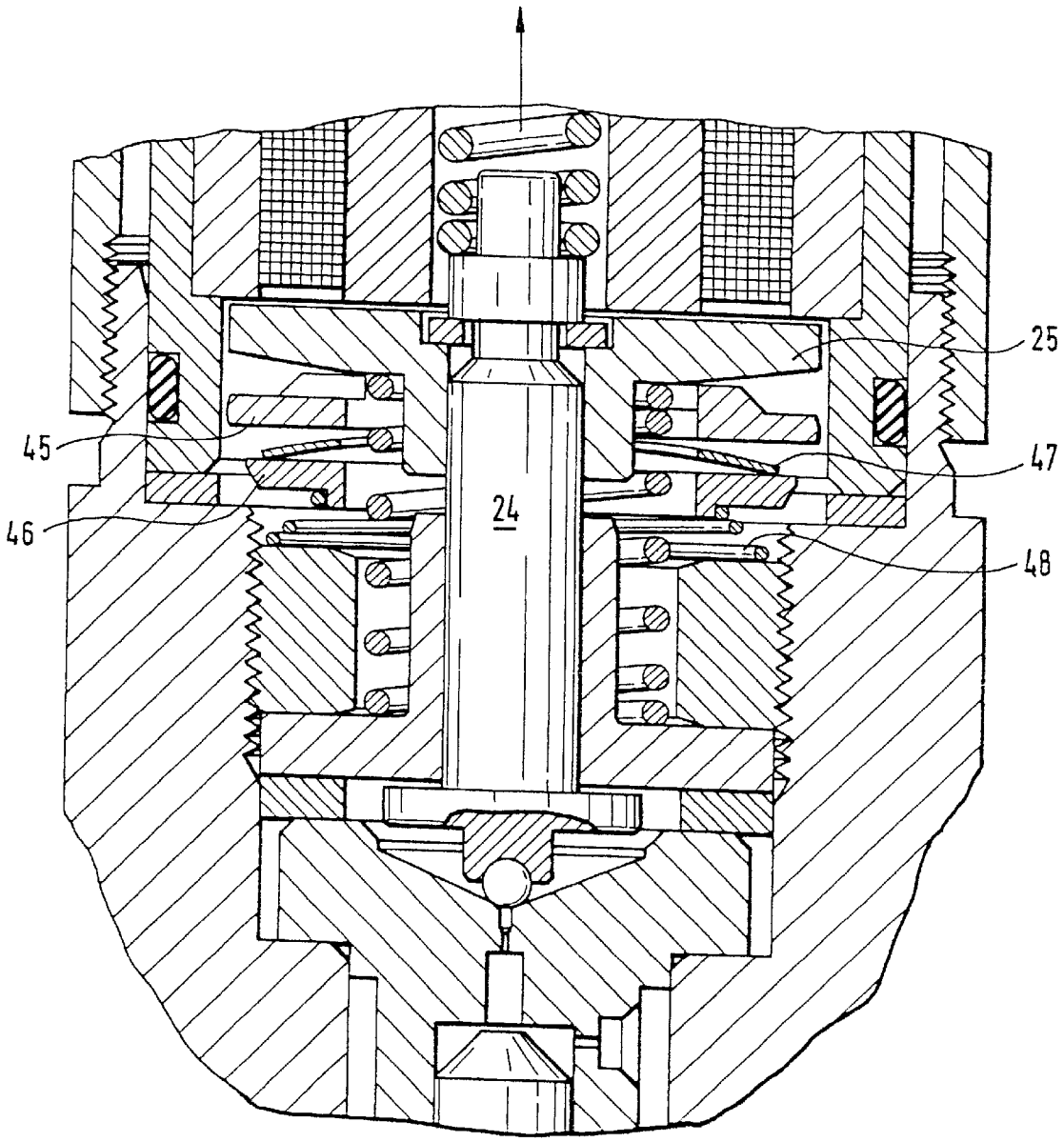
FIG. 5 is an illustration corresponding to that of FIG. 2, but with a two-part mass body.

FIG. 5 shows another embodiment according to the invention, in which, instead of a mass body 35 as shown in FIG. 2, two mass bodies 45, 46 are provided. The mass body 45 adjacent the armature plate 25 corresponds in design essentially to the mass body 35 shown in FIG. 2, but preferably has a lower mass than the mass body 35. The mass body 45 is arranged in spaced relationship from the mass body 46. Preferably, a spring element 47 is arranged as a spacer between the mass bodies 45 and 46. The spring element 47 may be formed for example by a low-curvature, thin, spring-steel disc. The spring-steel disc 47 (Belleville disc) acting as a spacer, prevents the two mass bodies 45 and 46 from becoming attached to one another. Because of the hydraulic flow relationship and/or pressure differences the two bodies are also prevented from adhering to one another so that they cannot act as a single-piece body. Furthermore, the spring 47 also ensures that the abutment energy of the armature plate 25 is transmitted first to the mass body 45 and then to the mass body 46, so that, after short successive abutments, the mass body 45 is available again as an impulse partner for the armature plate 25.

Concerning the design and configuration of the mass-body spring 48 supporting the mass body 46, reference is made to what was said with regard to the arrangement and the design of the mass-body spring 39 according to FIG. 2.

Figure 6:
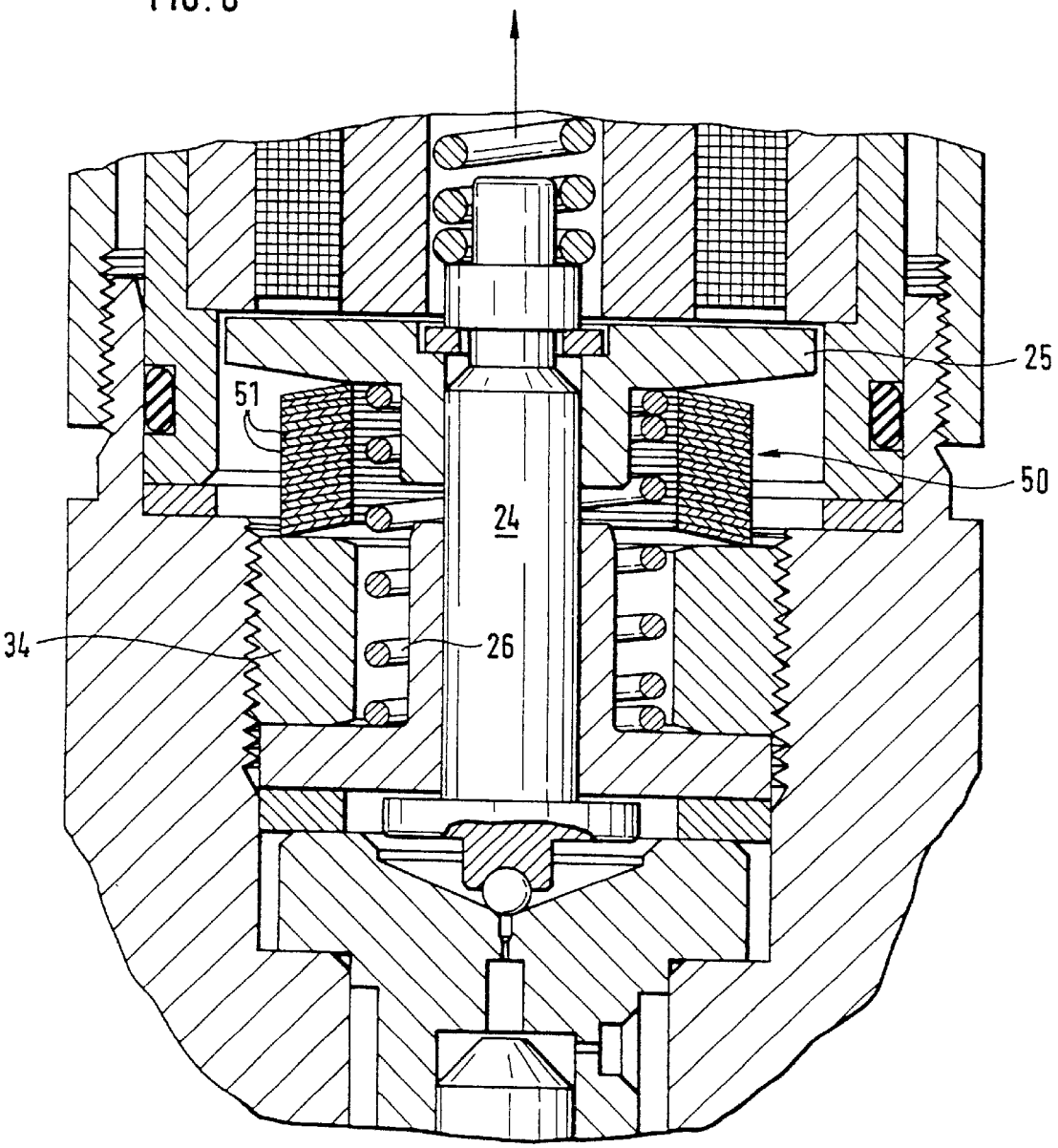
FIG. 6 is an illustration corresponding essentially to that of FIG. 2, including a mass body and/or damper consisting of layered washers, the mass body and/or damper being built up essentially in the form of Belleville springs.

FIG. 6 shows still another embodiment, in which the mass body is provided in the form of a layered spring assembly. It is designated as a whole by the numeral 50. The spring assembly may be composed of planar or curved discs 51. In the exemplary embodiment shown, the discs 51 are disposed one on top of the other similarly to the arrangement of leaf springs. They touch one another over a relatively large area, whereby oscillations are damped as a result of the friction generated between adjacent discs 51.

When, in an embodiment of this kind, the armature plate 25 rebounds, it acts upon the spring assembly 50 as a mass body. The resulting deformation of the spring assembly causes a displacement of the discs 51 relative to one another, which generates friction between adjacent discs providing for a damping action.

In the exemplary embodiment as illustrated, the disc assembly consists of bent sheet-metal washers, which are supported with their radially outer ends on the tension nut 34 while their radial center areas engage the armature plate 25.

Figure 7:
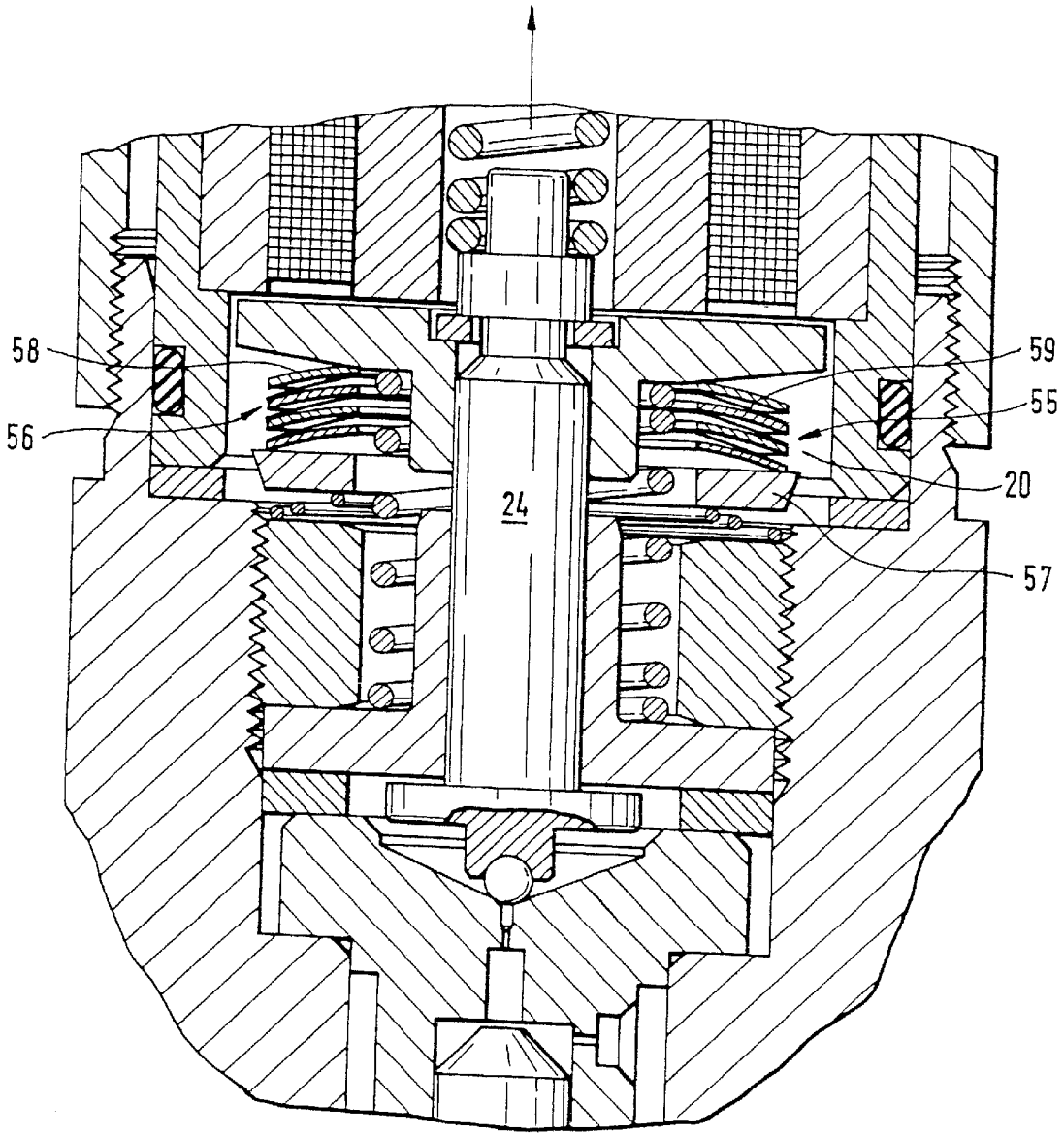
FIG. 7 is an illustration corresponding to that of FIG. 2 with a multi-part mass body and/or damper which is built up partially as a layered body comprising curved annular discs.

In the exemplary embodiment according to FIG. 7, a mass body 55 is provided, consisting of two part members 56 and 57, of which the part member 56 comprises a multi-layer make-up and the part member 57 comprises a single piece.

The multi-layer part member 56 consists of thin curved spring discs, designated 58 and 59, of which the spring discs 58 have a greater curvature than the spring discs 59. The spring discs 58 and 59 are disposed alternately one above the other, so that, in each case, a pair of discs 58, 59 is supported at the radially outer circumference and this pair of discs 58, 59 is supported relative to the next following pair of discs 58, 59 at the radially inner end. As a result gaps are formed between the discs which open alternately inward- and outwardly. Since the body 55 is arranged in the armature space 20 filled with liquid or that is, with fuel, these gaps are likewise filled with fuel. Consequently, when the part-body 56 is subjected to axial loads corresponding damping effects occur as the gap sizes change.

An embodiment of this kind may be used in a similar way as the mass body 50 according to FIG. 6, that is, in place of a single, layered mass body.

The arrangement according to the invention using an additional single piece mass body as part member 57, provides for particularly good preconditions for an injection behavior which is unaffected by oscillations, even by rebound oscillations. A high-pressure fuel injection nozzle is obtained herewith, in which the predetermined injection values are not falsified due to oscillations.

Figure 8:
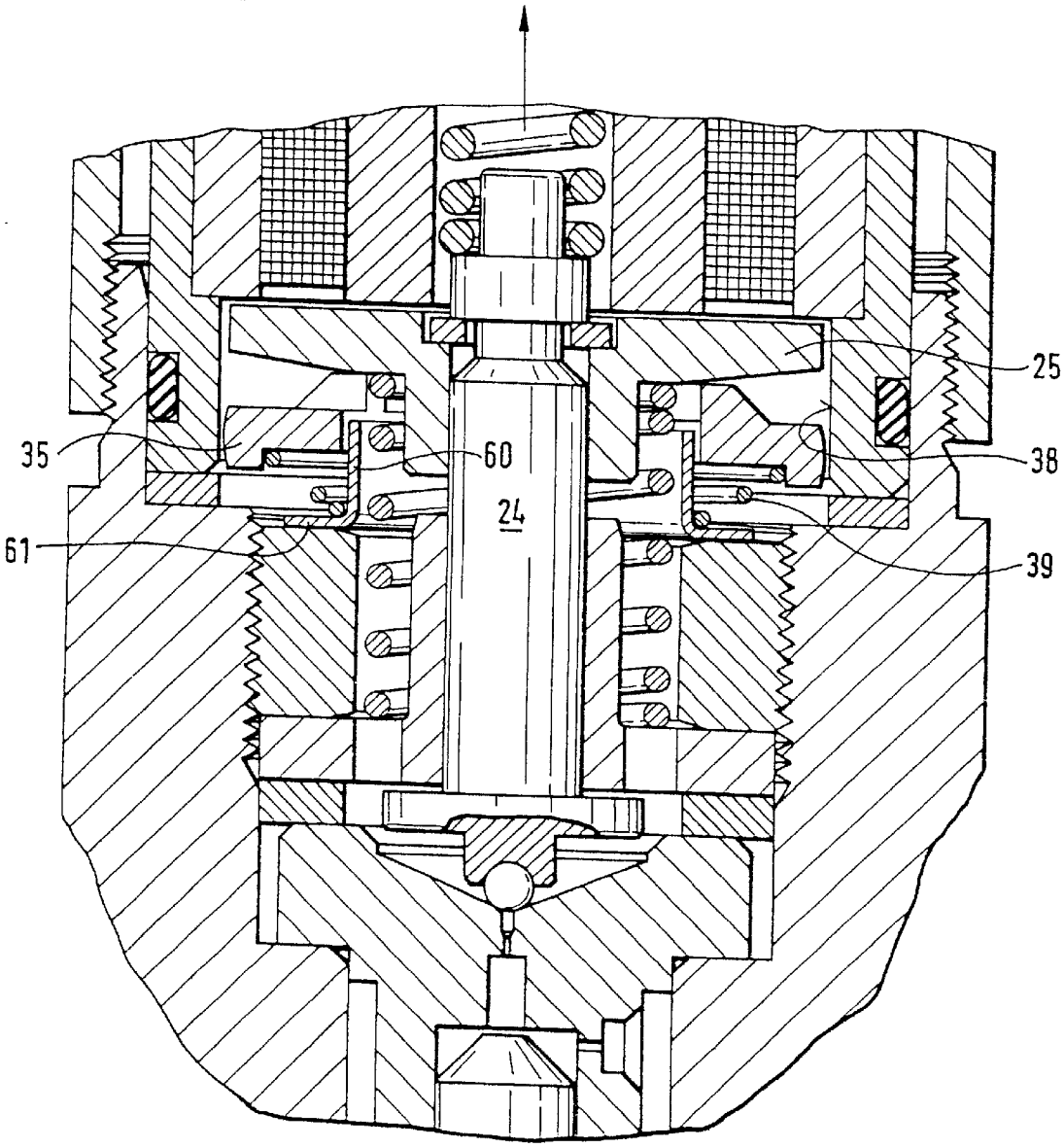
FIG. 8 is an illustration according to FIG. 2, wherein the mass body is provided with a guide tube for increased hydraulic damping.

Hydraulic damping, as it is obtained in particular in the exemplary embodiment according to FIG. 7, may be implemented with an embodiment according to FIG. 8, in which the mass body 35 is used as an annular piston. In the armature space 20, a correspondingly annularly delimited liquid volume is provided in such a way that, in the event of axial displacement of the annular piston, the displaced fuel volume can flow out only through narrow gaps, thus resulting in corresponding frictional losses and damping. This damping principle resembling shock absorber damping can be implemented at little outlays. The inside diameter of the annular mass body 35, which extends radially virtually up to the circumferential wall 38 of the armature space 20, is formed by a guide tube 60 which delimits the annular space inwardly and which leaves only a narrow gap relative to the inner circumference of the mass body 35. As a result, axial movements of the mass body 35 lead to corresponding liquid displacements. The displaced liquid has to flow out through the remaining gaps generating frictional losses resulting in corresponding damping effects. For fixing the guide tube 60, the latter is provided at its lower end with a radially outward projecting collar 61, on which the mass-body spring 39 is seated so that corresponding fixing is provided for without any additional outlay.

Figure 9:
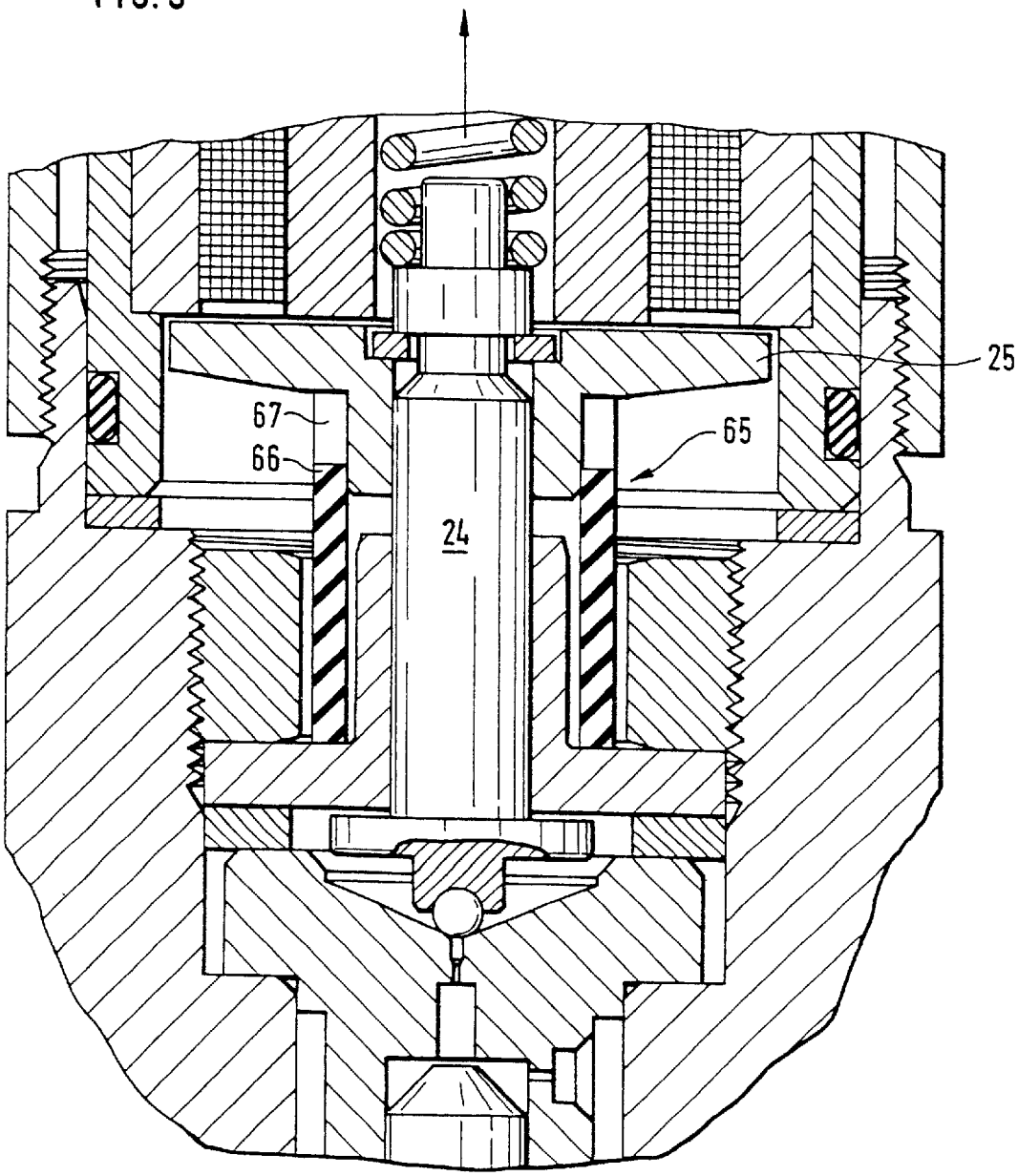
FIG. 9 is an illustration corresponding to the marked-out portion of FIG. 2, wherein the armature plate is supported by an armature spring having high internal material damping.
Figure 10:
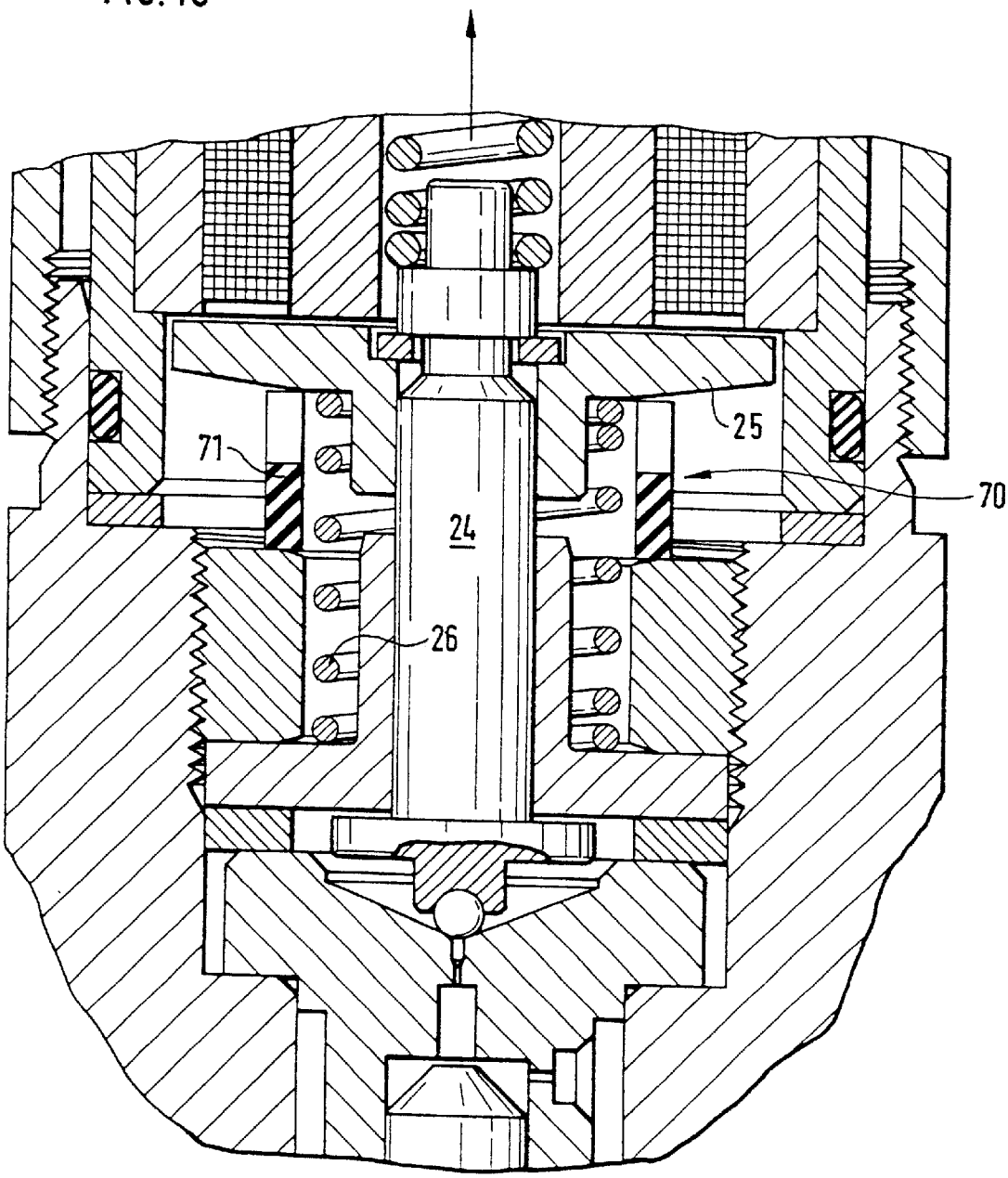
FIG. 10 is an illustration, which corresponds essentially to that of FIG. 3 and in which the armature spring is formed by a resilient support body with high internal material damping.

FIGS. 9 and 10 show embodiments in which, the damper 65 is formed by an elastic support body supporting the armature plate 25 and having especially high internal material damping. The supporting body according to FIG. 9, designed as a damper 65, is formed by a tubular elastic element, designated 66, which, in the embodiment according to FIG. 9, additionally assumes the function of the armature spring of FIGS. 1 and 2. As indicated in FIG. 9, the elastic tube-like element 66 is provided with passage orifices 67, in particular in its region located near the armature plate 25, so that no closed off hydraulic chambers are formed. The arrangement of the tube-like supporting body is similar to that of the armature spring 26 in FIGS. 1 and 2.

In the exemplary embodiment according to FIG. 10, the armature plate is supported by an armature spring 26, in a similar way as shown for the embodiment of FIG. 2. In addition, a tube-like elastic supporting body 71 is arranged as a damper 70, in parallel with the armature spring 26. The elastic body 71 is disposed between the armature plate 25 and a component fixed to the housing. In this case, too, the tube-like elastic body has radial passages so that the axial movement of the armature plate 25 is not affected by hydraulic support effects.

Materials with high internal material damping which are considered are, inter alia, rubber-like materials. They preferably also have a high specific gravity in order to provide the desired mass damping effect.

Particularly if radial passages are formed in the tube-like element 60 or 71, corresponding resilient properties can also be provided by the tube-like element. The region of support for the armature plate may also be formed by column-like support regions distributed over the circumference of the tube-like element 71.

The invention makes it possible, particularly with a combination of the various damping possibilities referred to, to adapt the arrangement to particular requirements. The design features referred to and illustrated in the exemplary embodiments, although considered to be particularly advantageous in combination, may also be important features for independent use.

The invention provides for an arrangement by which the adverse effects of oscillations resulting from the timing of the fuel injection are eliminated. The oscillations can be shifted by "intermediate storage" out of time segments, which are critical for the control of the injection timing operation, to time segments, in which their effects on the system are negligible. Additionally, damping may be superposed on the operation or the damping may be employed independently.

What is claimed is:

1. A control device for a high pressure injection nozzle for a liquid injection medium, which is supplied to the nozzle under high pressure to be metered by the nozzle with regard to injection timing, injection duration and injection quantity, particularly an actuating device for a high pressure fuel injection nozzle for internal combustion engines, said control device comprising: a housing, an actuating magnet structure disposed in said housing and including a magnet coil, an armature disposed in said housing so as to be movable relative to said magnet coil, a valve actuating bolt engaged by said armature and being spring biased to a seated position in which said injection nozzle is closed but being actuated by said armature upon energization of said magnet coil to an unseated position, in which said injection nozzle is opened for the release of said liquid injection medium from said injection nozzle, said armature being movably mounted on said armature bolt, and a resiliently supported mass body disposed adjacent said armature at the side thereof remote from said magnet coil so that, when, upon de-energization of said magnet coil, said bolt reaches its seated position, said armature is free to continue to move for engagement with said mass body to which the mass impulse forces of the armature are transferred whereby the mass forces generated by the bolt are reduced and any movement of the armature is damped.

2. A control device according to claim 1, wherein said mass body is resiliently supported by a spring which is pre-stressed to engage the mass body with a force of a magnitude corresponding to the inertia force generated by the mass body when engaged by the armature plate upon de-energization of the magnet coil.

3. A control device according to claim 1, wherein said mass body has the form of an annular plate.

4. A control device according to claim 3, wherein said armature includes a neck surrounding said armature bolt and said annular plate surrounds said neck.

5. A control device according to claim 3, wherein said armature plate is disposed in a cylindrical armature space formed in said housing and said annular plate has an outer circumference corresponding essentially to the circumference of the cylindrical armature space.

6. A control device according to claim 3, wherein said annular plate includes axial projections projecting toward the armature plate for engagement therewith.

7. A control device according to claim 6, wherein axial projections are formed at a radially inner area of said annular plate.

8. A control device according to claim 6, wherein said axial projections are arranged in circumferentially spaced relationship so as to provide passages therebetween.

9. A control device according to claim 6, wherein said axial projections are arranged all at the same radius.

10. A control device according to claim 1, wherein said mass body is supported by a spirally coiled spring.

11. A control device according to claim 10, wherein said spirally coiled spring has turns of a diameter and a spring wire thickness permitting the spring to be disposed flat in a plane when fully compressed.

12. A control device according to claim 1, wherein said mass body is in the form of a disc spring.

13. A control device according to claim 1, wherein said mass body comprises two separate body members.

14. A control device according to claim 13, wherein said two separate body members of said mass body are disposed adjacent each other and one of said separate body members is disposed adjacent said armature plate so as to rest on said armature plate.

15. A control device according to claim 14, wherein the other of said separate body members is supported so as to be resiliently movable relative to said one body member.

16. A control device according to claim 15, wherein the two body members of said mass body are supported relative to each other by way of a disc spring.

17. A control device according to claim 15, wherein said other body member of said mass body is supported by a spirally coiled helical spring biasing said other body member toward said armature.

18. A control device according to claim 1, wherein the space, in which said mass body is disposed is filled with a hydraulic liquid.

19. A control device according to claim 18, wherein said mass body is an annular body contained in said liquid-filled space, the liquid-filled space being essentially closed to contain the liquid.

20. A control device according to claim 19, wherein said liquid filled space has an inner limitation provided by a tube supported in said housing and the annular mass body closely surrounds said tube.

21. A control device according to claim 20, wherein said tube includes a radially outwardly projecting collar by way of which it is axially fixed in said housing.

22. A control device according to claim 1, wherein said mass body consists of a number of discs forming a layered body.

23. A control device according to claim 22, wherein said layered body is constructed so as to be inherently resilient.

24. A control device according to claim 2, wherein the pre-stressing force of said mass body support spring, the spring constant of the mass body support spring, and the damping of its movement are so selected that, after being subjected to an impulse from said armature, the mass body assumes its initial position prior to the next following magnet energization.

* * * * *